US006948404B1

(12) United States Patent
Chokshi

(10) Patent No.: US 6,948,404 B1
(45) Date of Patent: Sep. 27, 2005

(54) EASY JAR OPENER

(75) Inventor: Sonia Chokshi, Tampa, FL (US)

(73) Assignee: Sheela S. Chokshi, Tampa, FL (US)

( * ) Notice: Subject to any disclaimer, the term of this patent is extended or adjusted under 35 U.S.C. 154(b) by 0 days.

(21) Appl. No.: 10/772,598

(22) Filed: Feb. 6, 2004

(51) Int. Cl.[7] ..... B67B 7/14; B67B 7/18
(52) U.S. Cl. ..... 81/3.43; 81/3.07; 81/64
(58) Field of Search ..... 81/3.43, 3.09, 81/3.25, 3.32, 3.36, 64

(56) References Cited

U.S. PATENT DOCUMENTS

| | | | | | |
|---|---|---|---|---|---|
| 896,696 | A | * | 8/1908 | Lind | 81/65 |
| 2,132,207 | A | * | 10/1938 | Donovan | 81/3.43 |
| 2,317,037 | A | * | 4/1943 | Donovan | 81/3.43 |
| 3,678,788 | A | * | 7/1972 | Matti | 81/3.43 |
| 4,306,470 | A | | 12/1981 | Woloszyn | |
| 4,532,831 | A | | 8/1985 | Ackerson | |
| 4,766,781 | A | | 8/1988 | Grise | |
| D307,101 | S | * | 4/1990 | Anderson | D8/22 |
| 5,390,570 | A | * | 2/1995 | Reisner | 81/64 |
| 5,522,284 | A | * | 6/1996 | Sade | 81/3.43 |
| D440,842 | S | | 4/2001 | Vandergaw | |
| D474,661 | S | * | 5/2003 | Huang | D8/22 |
| 6,581,497 | B1 | * | 6/2003 | Kelton | 81/3.32 |

* cited by examiner

*Primary Examiner*—Joseph J. Hail, III
*Assistant Examiner*—Alvin J Grant

(57) ABSTRACT

The present invention provides a jar opener which is designed for easy handling by people with arthritis. The jar opener providing a larger than normal handle with one end being flat and non functional while the opposite end is indented in a concave dish design, with a gripping teeth thereon, so as to accommodate and mate with the ribbed edge of any cap on ajar. A gripping strap loosely wraps around the cap of ajar while the opposite end of the strap aligns and tightens onto the opposite side of the handle by a releasable securing means, such as VELCRO. The user then grasps the handle of the present invention in one hand and uses their opposite hand to stabilize the jar. The user simple applies grasping pressure on the handle of the present invention and pushes in a counter clockwise direction thereby loosening the cap while rotating the cap of the jar to the open position. The strap is sufficiently long enough to be wrapped around any size circumference of a cap. The present invention has a preferred list of component parts and a method of use sequence for removing the cap of any jar.

5 Claims, 4 Drawing Sheets

EASY JAR OPENER

BACKGROUND OF THE INVENTION (1) Field of the Invention

The present invention generally relates to jar openers and, more particularly pertains to a device with a handle while having an attached adjustable strap so as to be able to wrap around and engage any size cap on a jar.

(2) Description of the Prior Art

There have been numerous patents granted in the field of jar openers such as U.S. Pat. No. 4,766,781 where two conical members create a means for removing the cap of a jar. In U.S. Pat. No. 4,532,831 a jar opener is shown comprising a cord looped around the cap with a handle. The cord is twisted which applies pressure to the cap and thereafter removes the cap of the jar. In U.S. Pat. No. 4,306,470 the invention has an elongated handle with a semicircular jaw at one end and a second jaw on the other end. When closed around the cap the jaws provide enough pressure so as to open a jar. In U.S. Pat. No. D 440,842, the invention provides two adjustable jaws which grip the cap on two opposite sides. A handle is provided so as to grasp and twist the cap thereby removing the cap of a jar.

SUMMARY OF THE INVENTION

In view of the forgoing disadvantages inherent in the known jar openers now present in the prior art, the present invention provides an improved jar opener for people with arthritis. Each uses the same basic principle. As such the general purpose of the present invention, which will be described subsequently in greater detail, is to provide a new and improved jar opening apparatus and method of use which has all the advantages of the prior art and none of the disadvantages.

To attain this, the present invention provides a jar opener which is designed with easy handling for people with arthritis. The present invention also provides a larger than normal handle with one end being flat and non functional while the opposite end is formed into a concave dish design, with a gripping teeth thereon, so as to accommodate and engage with the ribbed edge of any cap on a jar. An adjustable gripping strap is provided with the inside being of a rough serrated surface. The rough side of the strap grips and mates with the ribbed texture of any jar cap. One end of the gripping strap is permanently attached to one side of the handle. The adjustable gripping strap loosely wraps around the cap of a jar while the opposite end of the strap aligns and tightens onto the opposite side of the handle by a releasable securing means, such as VELCRO. The user then grasps the handle of the present invention with one hand and uses their opposite hand to stabilize the jar. The user simply applies grasping pressure on the handle of the present invention and pushes in a counter clockwise direction thereby loosening the cap while rotating the cap of the jar to the open position. All caps on jars are removed by twisting in a counter clockwise while the tightening is accomplished by twisting in a clockwise direction. The size of the handle is specifically designed to be larger than normal. This increased size allows a person with arthritis to easily wrap their hand and fingers around the handle thereby creating a better grip so as to easily turn the handle thereby opening the cap of any size jar. The shape of the handle ranges from round to square or hexagon. The more edges the easier it will be to grip the handle; such as a hexagon shaped handle. The handle is approximately 5 to 6 inches long and approximately ½ of an inch to 3 inches in diameter; preferred is 2 inches in diameter. The handle of the present invention is best manufactured by injection molding. Within the molding procedure a recessed area is built into one side which accommodates one end of the gripping strap. A permanent attachment means secures the strap to the handle at this position. The strap may be selected from a rubber, plastic or a nylon material with one side being smooth while the other side has a rough serrated surface so as to be able to mate or grasp the rough outer edge of the cap for the jar. The strap is sufficiently long enough to be wrapped around any size circumference of a cap. The strap length ranges from 6 inches to 20 inches. Preferred is approximately 12 inches. The strap must be long enough to wrap around the complete cap of the jar and return to the handle and be secured onto the handle by a releasable securing means. The present invention has the following list of component parts:

(1) A gripping handle;
(2) An adjustable strap;
(3) A permanent attachment means for the first end of the strap to the handle;
(4) A releasable securing means for the loose end of the strap.

The present invention also has a method of use sequence for removing the cap of any jar:

(a) Wrap the provided strap around the outer edge of the cap on the jar;
(b) Secure the strap back onto the opposite side of the handle;
(c) Grasp the present invention by the handle with one hand;
(d) Grasp and stabilize the selected jar with the opposite hand;
(e) Push the handle in an operational counter clockwise direction until the cap is in the open position;
(f) Release the strap from the handle securing means thereby releasing the cap from within the grasp of the strap.

The present invention is designed for easy use especially for people with arthritis with limited use of their hands and fingers. The larger than normal handle increases the leverage factor for an easy to use invention. The strap is long enough so as to accommodate any size cap. The releasable securing means may optionally be selected from a material such as VELCRO which have hook and pile surfaces. One surface of the VELCRO would be attached to the handle surface, such as the pile surface, and the other surface of the VELCRO would be the hook surface which is attached to the inside surface of the strap. Both would be attached to the respective surface by means of a sticky tape means.

There has thus been outlined, rather broadly, the jar opener apparatus of the invention in order that the detailed description thereof that follows may be better understood, and in order that the present contribution to the art may be better appreciated. There are, of course, additional features of the present invention that will be described hereinafter and which will form the subject matter of the claims appended hereto.

In this respect, before explaining at least one embodiment of the present invention in detail, it is to be understood that the present invention is not limited in its application to the details of construction and the arrangement of the components set forth in the following description or illustrated in the drawings. The invention is capable of other embodiments and of being practiced and carried out in various ways, also, it is to be fully understood that the phraseology and terminology employed herein are for the purpose of description and should not be regarded as limiting.

As such, those skilled in the art will appreciate that the concept, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the present application. The abstract is neither intended to define the invention of the application, which is measured by the claims, nor is it intended to be limited as to the scope of the present invention in any way.

It is therefore an object of the present invention to provide a new and improved jar opener which has the advantage of the prior art devises and none of the disadvantages.

It is another object of the present invention to provide a new and improved jar opener which may be easily and efficiently manufactured and marketed.

It is a further object of the present invention to provide a new and improved jar opener which is of a durable and reliable construction.

An even further object of the present invention is to provide a new and improved jar opener which can be manufactured a low cost with regard to both materials and labor, and which accordingly can be sold at low prices to the consuming public, thereby making such jar opening apparatus economically available to the buying public.

Still yet another object of the present invention is to provide a new and improved jar opener which provides the apparatuses and methods of the prior art some of the advantages thereof, while simultaneously overcoming some of the advantages normally associated therewith.

Still another object of the present invention is to provide a new and improved jar opener operable from a novice's level.

Yet another object of the present invention is to provide a new and improved system for opening a jar.

These together with other objects of the present invention, along with the various features of novelty which characterize the present invention, are pointed out with a particularity in the claims annexed to and forming a part of this disclosure. For a better understanding of the present invention, its operating and installation advantages and the specific objects attained by its uses, reference should be had to the accompanying drawings and descriptive matter in which there are illustrated preferred embodiments of the present invention.

BRIEF DESCRIPTION OF THE DRAWINGS

The invention will be better understood and objects other than those set forth above will become apparent when consideration is given to the following detailed description such description makes reference to the annexed drawings wherein.

DESCRIPTION OF THE PREFERRED EMBODIMENT

Figure 1:
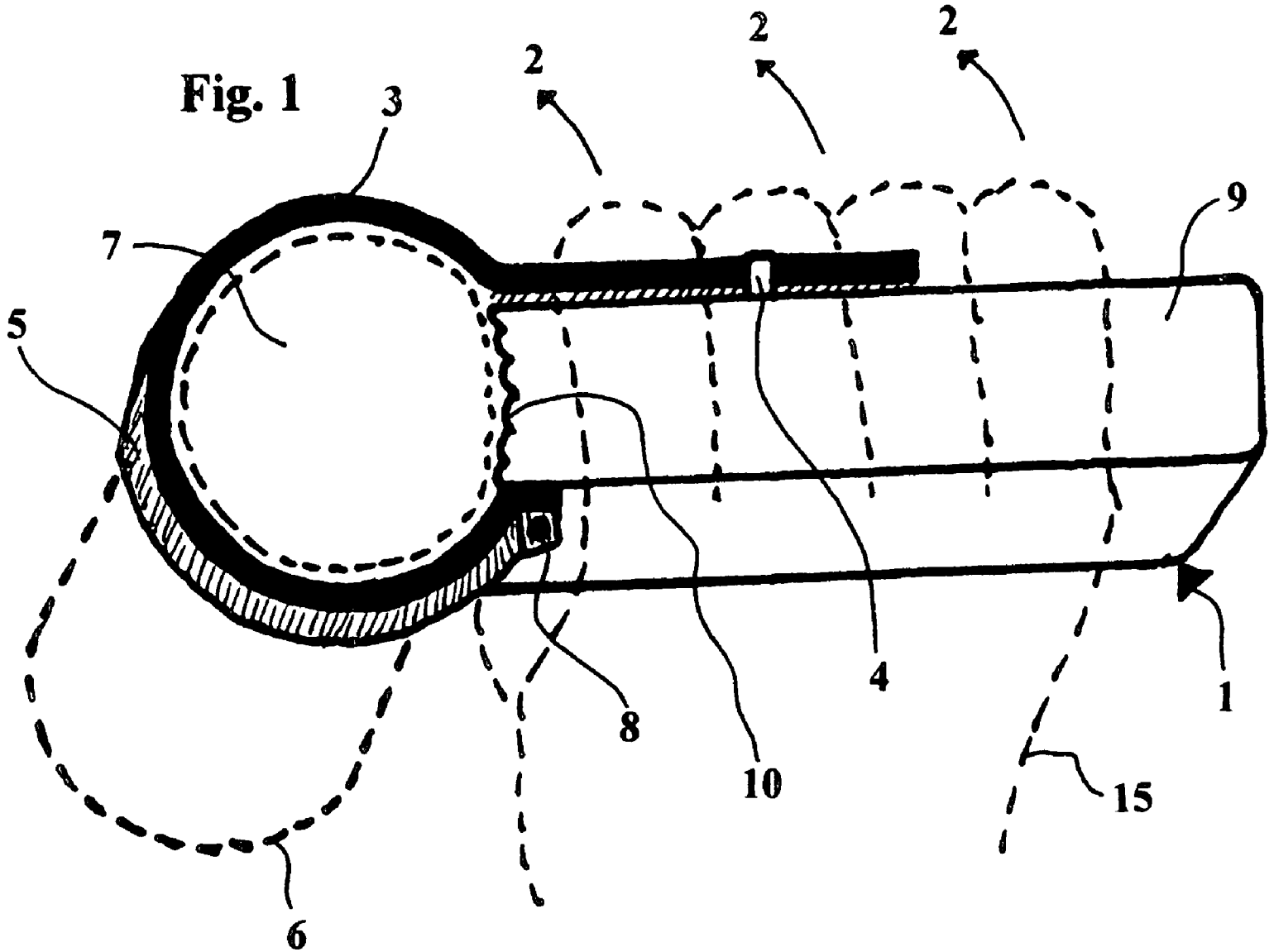
FIG. 1 is a perspective view showing the invention, in solid lines, placed around the cap of a jar, in dotted lines, and the user's hand, in dotted lines, positioned on the handle of the invention.

The present invention in FIG. 1 presents the jar opener 1 showing the position of the user's band 15, in dotted lines, grasped around the handle 9 pushing in a general counter clockwise direction 2. The top of the strap 3 is shown with the outside of the strap 5 wrapped around the jar 6 with cap 7. One end of strap 3 is permanently attached to the handle 9 by securing means 8. The gripping teeth 10 of the handle 9 for the jar opener 1 mates with the rough edge of cap 7 thereby creating a means to enable the jar opener 1 to remove the cap 7 from jar 6. The strap 3 is releasably secured by securing means 4 on handle 9. The loose end of strap 3 slides into and through securing means 4 thereby securing the strap 3 so as not to slip while the strap 3 is placed around the cap 7.

Figure 2:
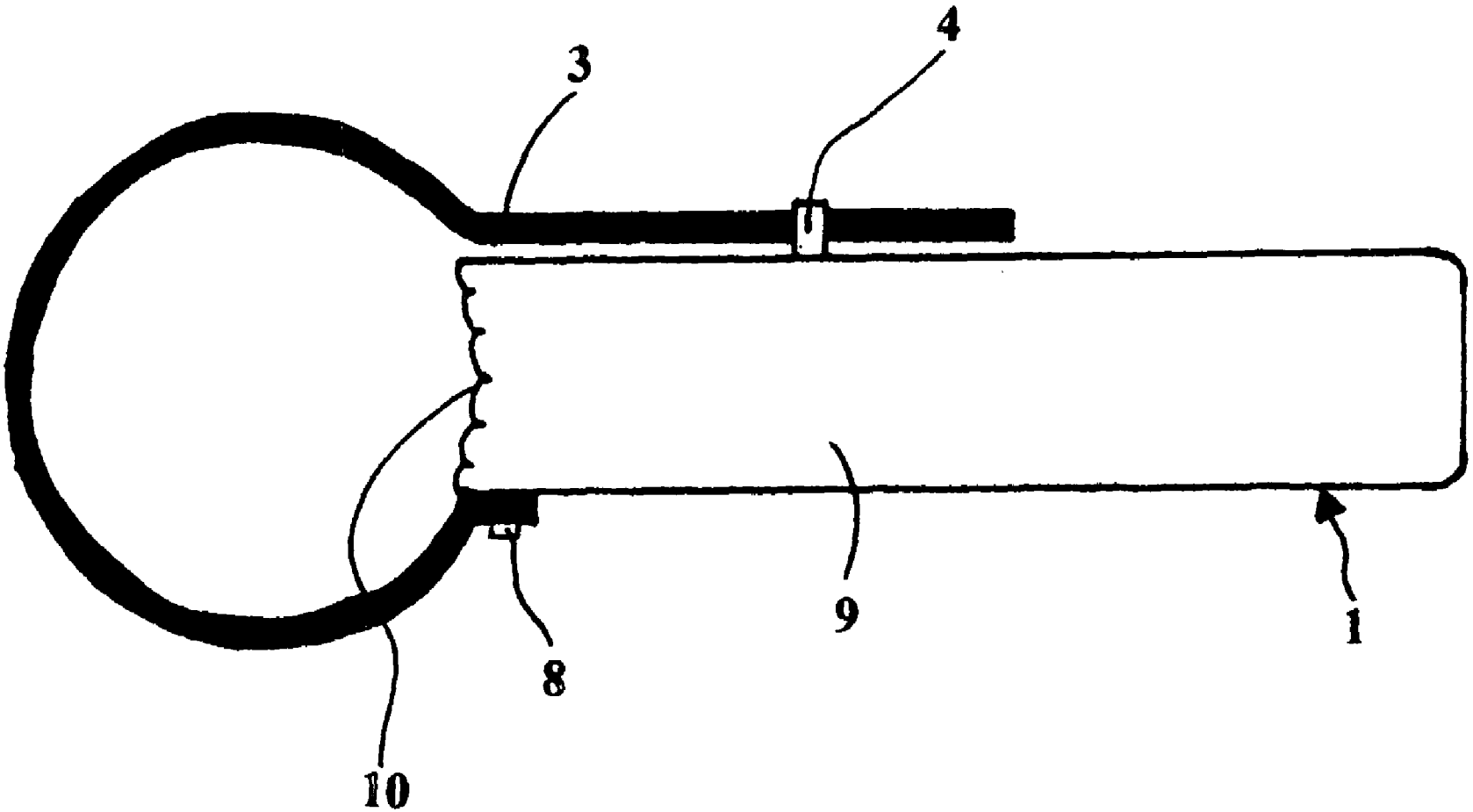
FIG. 2 is a flat top view of the invention

FIG. 2 reveals a view of the jar opener 1 with handle 9 with strap 3 permanently attached by securing means 8 to handle 9 while the loose end of strap 3 is releasably secured to handle 9 by securing means 4. The end gripping teeth 10 are shown at one end on handle 9. As in FIG. 1 the releasable securing means for the loose end of strap 3 may optionally be VELCRO.

Figure 3:
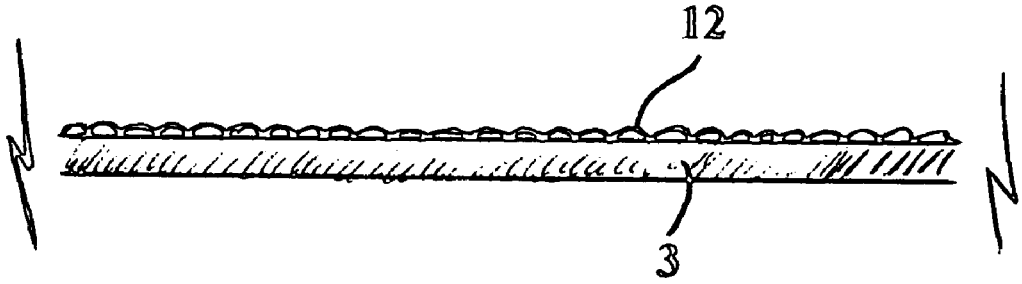
FIG. 3 is a top view of the strap.

FIG. 3 is a top view of the strap 3 showing the rough gripping surface 12 on one side of strap.

Figure 4:
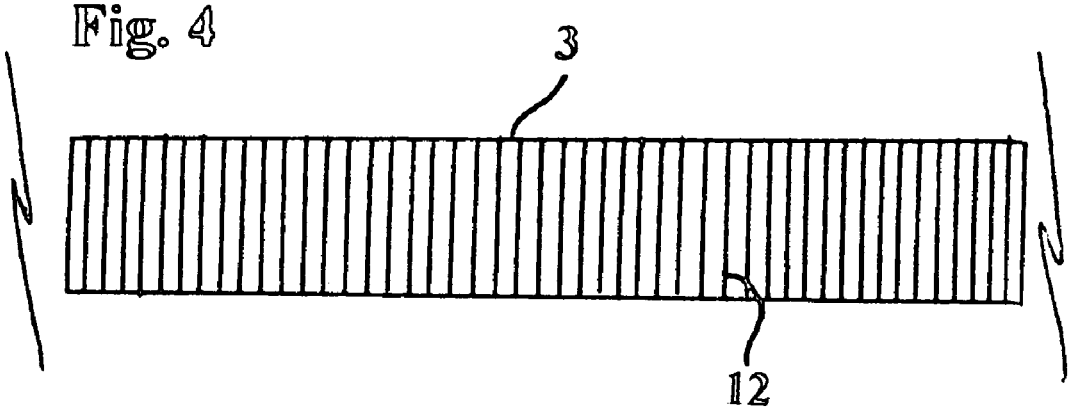
FIG. 4 is a flat view of the rough side of the strap.

FIG. 4 is a flat view of strap 3 with rough gripping surface 12.

Figure 5:
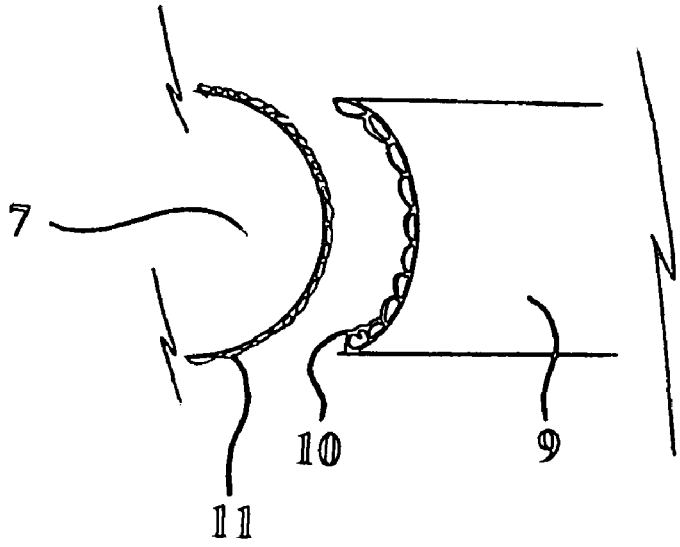
FIG. 5 is a close up flat view of outer edge of the jar and the gripping teeth end of the handle.

FIG. 5 is a close up detailed view of the handle 9 with the gripping teeth 10 and the jar cap 7 with gripping surface 11. When gripping teeth 10 come in contact with the caps outer gripping surface lithe two mutually mate and create a means for the jar to be stabilized in a stationary position to the handle 9. This stops any slippage until the strap is attached to the handle. The strap now performs the balance of the pressure so as to crack and move the cap 7 to an open position.

Figure 6:
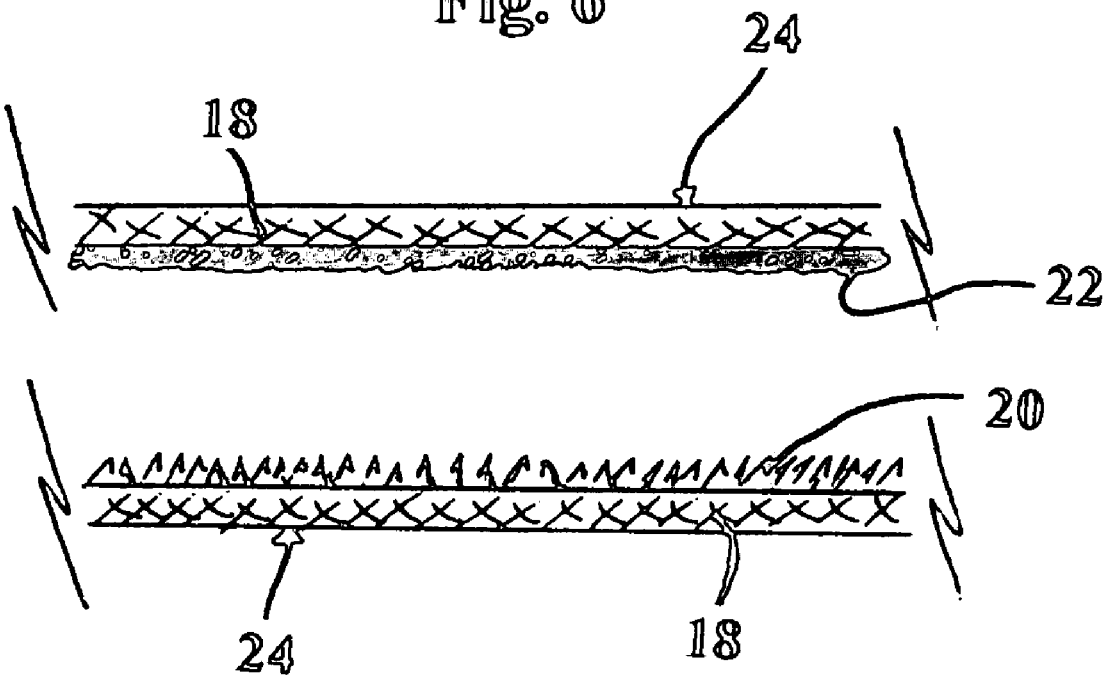
FIG. 6 is a top view of the hook and pile surface of the VELCRO releasable attachment means.

FIG. 6 is a top view of the two pieces of VELCRO 18 showing pile surface 22 and hook surface 20. Both pieces of VELCRO 18 show a sticky tape on the outer surface 24 which may optionally be used as the releasable securing means within the scope of the present invention. One VELCRO surface would be attached to the inside surface of the strap and the opposite VELCRO surface would be attached to the side of the handle.

The scope within the present invention has designed a very simple jar opener which allows people with arthritis to open ajar.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will be readily understood by those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An easy to use jar opener especially for people with arthritis, comprising in combination: a substantially elongated handle, said handle defining a longitudinal axis, and wherein said handle having a distal end and a proximal end, with the distal end defining a arcuate surface generally perpendicular to said longitudinal axis, and wherein said arcuate surface contains gripping teeth for frictionally engaging a jar lid and wherein said teeth mate with lids having ribbed edges; an adjustable strap member having a distal end and a proximal end, wherein said distal end is fixedly attached to a side in the longitudinal plane of said handle and adjacent said concave surface, and wherein said strap member is ribbed so as to frictionally engage said lids, and wherein said proximal end of said strap and the region adjacent thereto is detachably secured to the exterior longitudinal surface of the handle at the side opposite the side on which the distal end is attached; and means for detachably securing said strap to said handle.

2. The jar opener as claimed in claim 1, wherein said handle means comprises: a preferred length of approximately 5 inches; said handle having round, square or hexagonal cross-sections; preferably hexagonal with the diameter ranging from ½ inch to 3 inches preferably 2 inches.

3. The jar opener as claimed in claim 1, wherein said handle is manufactured by injection molding.

4. The jar opener as claimed in claim 1, wherein said gripping strap is sufficiently long and wide so as to accommodate any size lid.

5. The jar opener as claimed in claim 1, wherein detachably securing means is VELCRO.

* * * * *